US008570115B2

(12) United States Patent
Xiong et al.

(10) Patent No.: US 8,570,115 B2
(45) Date of Patent: Oct. 29, 2013

(54) POWER DIVISION NETWORK DEVICE

(75) Inventors: Xianzhi Xiong, Shenzhen (CN); Bangchang Xu, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 330 days.

(21) Appl. No.: 13/073,189

(22) Filed: Mar. 28, 2011

(65) Prior Publication Data

US 2011/0175788 A1 Jul. 21, 2011

Related U.S. Application Data

(63) Continuation of application No. PCT/CN2009/072753, filed on Jul. 14, 2009.

(30) Foreign Application Priority Data

Sep. 28, 2008 (CN) ..... 2008 1 0216628

(51) Int. Cl.
*H01P 5/12* (2006.01)

(52) U.S. Cl.
USPC ..... 333/100; 333/109; 333/115; 333/116

(58) Field of Classification Search
USPC ..... 333/100, 109, 115, 116
See application file for complete search history.

(56) References Cited

U.S. PATENT DOCUMENTS 3,295,134 A * 12/1966 Lowe ..... 342/368
5,006,821 A * 4/1991 Tam ..... 333/116
7,068,218 B2 * 6/2006 Gottl et al. ..... 342/368

(Continued)

FOREIGN PATENT DOCUMENTS

CN 1383590 A 12/2002
CN 1768447 A 5/2007
CN 101213705 A 7/2008
WO WO2010/037277 A1 8/2010

OTHER PUBLICATIONS

First Chinese Office Action dated (mailed) Feb. 21, 2012, issued in related Chinese Application No. 200810216628.X Huawei Technologies Co., LTD.
Written Opinion of the International Searching Authority (translation) dated (mailed) Oct. 22, 2008, issued in related Application No. PCT/CN2009/072753, filed Jul. 14, 2009, Huawei Technologies Co., Ltd.

(Continued)

*Primary Examiner* — Robert Pascal
*Assistant Examiner* — Kimberly Glenn
(74) *Attorney, Agent, or Firm* — Conley Rose, P.C.; Grant Rodolph; Nicholas K. Beaulieu

(57) ABSTRACT

The embodiment of the present disclosure discloses a power division network device, which comprises a shielding house and a circuit board. Two opposite surface layers of the circuit board are respectively provided with a signal transmission line and a coupling line. The signal transmission line and the coupling line are suspended in the shielding house. The coupling line comprises a coupling area, and a load interface and an output signal interface connected at the two ends of the coupling area. The projection of the coupling area on the surface layer where the signal transmission line is located falls onto the signal transmission line and forms thereon a projection area. The length of the projection area in the longitudinal direction of the signal transmission line is one quarter wavelength. Broadside coupling by way of making the projection of the coupling line fall onto the signal transmission line can realize the allocation and sampling of the signals transmitted in the signal transmission line. The coupling flatness is relatively good, and both strong and weak couplings can be attained.

9 Claims, 3 Drawing Sheets

(56) References Cited

U.S. PATENT DOCUMENTS

| | | | | |
|---|---|---|---|---|
| 7,839,235 | B2 * | 11/2010 | Xiong et al. | 333/116 |
| 2002/0113667 | A1 | 8/2002 | Tahara et al. | |
| 2004/0104792 | A1 | 6/2004 | Kim et al. | |
| 2009/0051462 | A1 | 2/2009 | Rottmoser et al. | |

OTHER PUBLICATIONS

International Search Report for International Application No. PCT/CN2009/072753, mailed Oct. 22, 2009 Huawei Technologies Co., LTD.

* cited by examiner

POWER DIVISION NETWORK DEVICE

CROSS-REFERENCE TO RELATED APPLICATIONS

This application is a continuation of International Application No. PCT/CN2009/072753, filed on Jul. 14, 2009, which claims priority to Chinese Patent Application No. 200810216628.X, filed on Sep. 28, 2008, both of which are hereby incorporated by reference in their entireties.

FIELD OF THE DISCLOSURE

The present disclosure relates to the field of telecommunications technology, in particular to a power division network device.

BACKGROUND OF THE DISCLOSURE

In wireless base station systems, the power division network devices are mainly used for equal or unequal power division of the signals transmitted from the base stations. Then, these signals after equal or unequal power division are transmitted to array antennas for power feeding thereof.

As shown in FIG. 1, multi-pass equal or unequal power division outputs can be achieved by using a power division network device of side-coupled structure. The main output ports of the device are located on the same side of the signal transmission line, with each stage being connected to a load resistor.

When implementing the present disclosure, the inventors find that the existing technologies have at least the following drawbacks.

First, when the coupling is strengthened, due to the increase in difference between the even-mode and odd-mode phase velocities caused by the heterogeneous media, the directivity will rapidly deteriorate. Therefore, strong coupling can not be achieved, and the technologies are only suitable for the scenario where the coupling is relatively weak.

Second, the coupling flatness is poor.

SUMMARY OF THE DISCLOSURE

Embodiments of the present disclosure provide a power division network device. It is not only capable of providing both strong and weak couplings, but also can deliver good coupling flatness.

Embodiments of the present disclosure comprise the following technical solutions.

A power division network device comprises a shielding house and a circuit board. Two opposite surface layers of the circuit board are respectively provided with a signal transmission line and a coupling line. The signal transmission line and the coupling line are suspended within the shielding house. The coupling line comprises a coupling area, and a load interface and an output signal interface connected at the two ends of the coupling area. The projection of the coupling area on the surface layer where the signal transmission line is located falls onto the signal transmission line and forms thereon a projection area. The length of the projection area in the longitudinal direction of the signal transmission line is one quarter wavelength.

An antenna feeder system comprises a power division network device and an antenna array. The power division network device comprises a shielding house and a circuit board. Two opposite surface layers of the circuit board are respectively provided with a signal transmission line and a coupling line. The signal transmission line and the coupling line are suspended within the shielding house. The coupling line comprises a coupling area, and a load interface and an output signal interface connected at the two ends of the coupling area. The projection of the coupling area on the surface layer where the signal transmission line is located falls onto the signal transmission line and forms thereon a projection area. The length of the projection area in the longitudinal direction of the signal transmission line is one quarter wavelength. The load interface is connected to an isolation resistor. The output signal interface is connected to the oscillators of the antenna array.

A communication device comprises a base station, a power division network device, and an antenna array. The power division network device comprises a shielding house and a circuit board. Two opposite surface layers of the circuit board are respectively provided with a signal transmission line and a coupling line. The signal transmission line and the coupling line are suspended within the shielding house. The coupling line comprises a coupling area, and a load interface and an output signal interface connected at the two ends of the coupling area. The projection of the coupling area on the surface layer where the signal transmission line is located falls onto the signal transmission line and forms thereon a projection area. The length of the projection area in the longitudinal direction of the signal transmission line is one quarter wavelength. The base station is connected to the signal transmission line of the power division network device. The load interface of the power division network device is connected to an isolation resistor. The output signal interface of the power division network device is connected to the antenna array.

Another communication device comprises a power division network device. The power division network device comprises a shielding house and a circuit board. Two opposite surface layers of the circuit board are respectively provided with a signal transmission line and a coupling line. The signal transmission line and the coupling line are suspended within the shielding house. The coupling line comprises a coupling area, and a load interface and an output signal interface connected at the two ends of the coupling area. The projection of the coupling area on the surface layer where the signal transmission line is located falls onto the signal transmission line and forms thereon a projection area. The length of the projection area in the longitudinal direction of the signal transmission line is one quarter wavelength. The load interface is connected to an isolation resistor.

The above technical solutions have the following advantages:

In the embodiments of the present disclosure, broadside coupling by way of making the projection of the coupling line fall onto the signal transmission line can realize the allocation and sampling of the signals transmitted in the signal transmission line. The coupling flatness is relatively good, and both strong and weak couplings can be attained.

BRIEF DESCRIPTION OF THE DRAWINGS

In the following, drawings to be used for explaining the embodiments of the disclosure or the prior arts will be briefly described, for the purpose of explaining the technical solutions of the embodiments of the present disclosure or of the prior arts more clearly. Obviously, the drawings as described in the following merely illustrate some embodiments of the present disclosure. For those skilled in the art, other drawings are readily obtainable in accordance with these drawings, without further inventive labor.

DETAILED DESCRIPTION OF THE EMBODIMENTS

In the following, reference will be made to the accompany drawings of the embodiment of the present disclosure to clearly and fully describe the technical solutions of the embodiments of the present disclosure. Obviously, the described embodiments are only a part, but not all, of the embodiments of the present disclosure. All other embodiments obtained without inventive labor by those of ordinary skill in the art based upon the embodiments of the present disclosure fall within the protection scope of the present disclosure.

Figure 1:
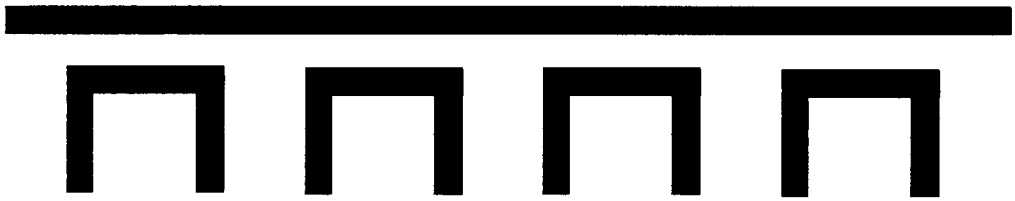
FIG. 1 is a schematic diagram depicting an existing power division network device.
Figure 2:
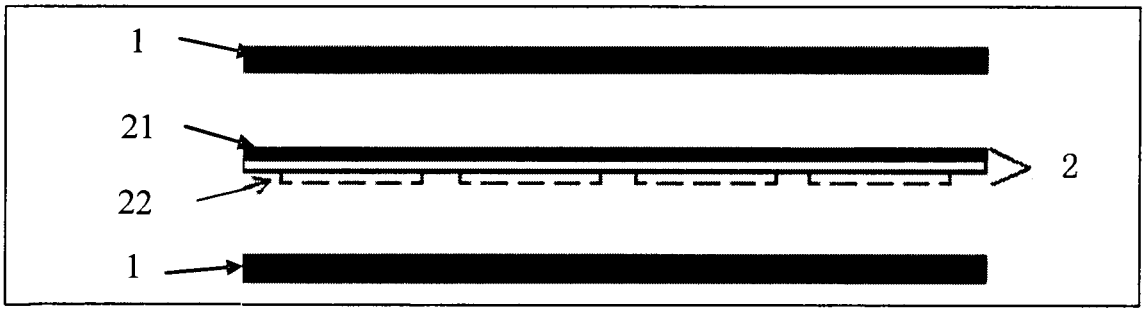
FIG. 2 is a schematic diagram depicting a power division network device according to an embodiment of the present disclosure.
Figure 3:
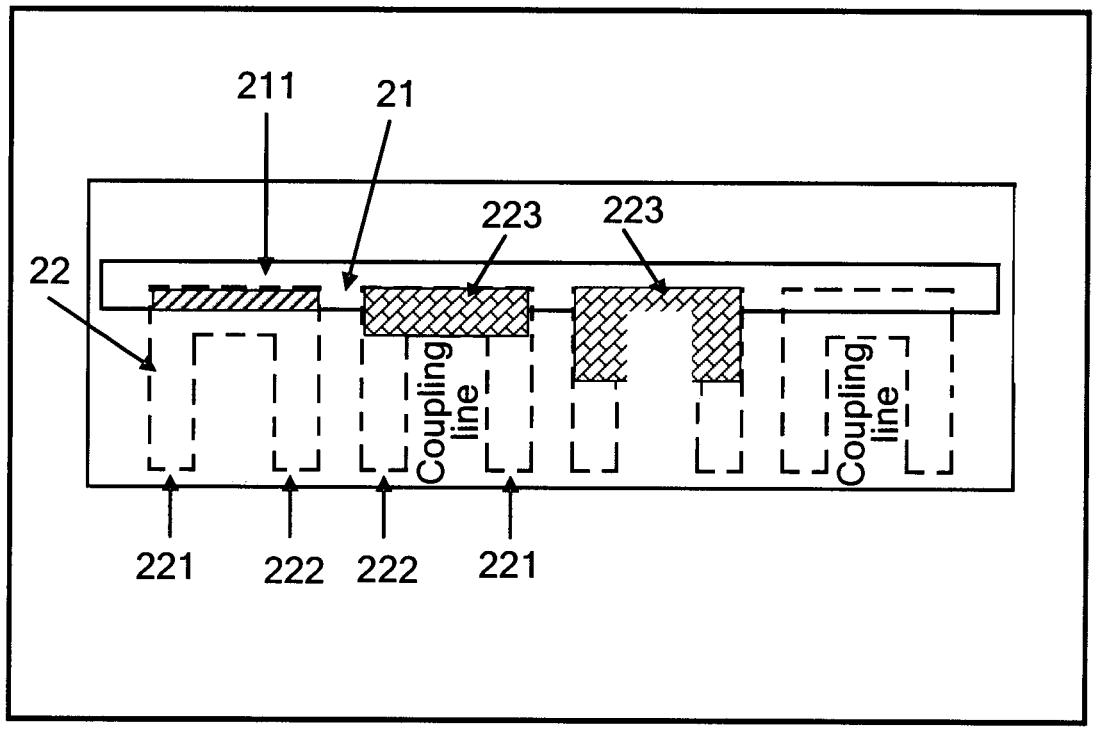
FIG. 3 is a schematic diagram depicting a power division network device according to another embodiment of the present disclosure.

As shown in FIG. 2 and FIG. 3, an embodiment of the power division network device of the present disclosure comprises a shielding house 1 and a circuit board 2. Two opposite surface layers of the circuit board 2 are respectively provided with a signal transmission line 21 and a coupling line 22. The signal transmission line 21 and the coupling line 22 of the circuit board 2 are suspended within the shielding house 1. The coupling line 22 comprises a coupling area 223, and a load interface 222 and an output signal interface 221 connected at the two ends of the coupling area 223. The projection of the coupling area 223 on the surface layer where the signal transmission line 21 is located falls onto the signal transmission line 21 and forms thereon a projection area 211. The length of the projection area 211 in the longitudinal direction of the signal transmission line 21 is one quarter wavelength.

In the above embodiment, broadside coupling by way of making the projection of the coupling line fall onto the signal transmission line can realize the allocation and sampling of the signals transmitted in the signal transmission line. The coupling flatness is relatively good, and both strong and weak couplings can be attained. Further, in the embodiments of the present disclosure, suspending the signal transmission line and the coupling line of the circuit board in the shielding house reduces the insertion loss, which enables the power capacity to be relatively high.

As shown in FIG. 3, in the embodiments of the present disclosure, the shape of the coupling area 223 of the coupling line 22 can be elongated, "U" shaped, circular, oval, or polygonal, etc.

In the embodiments of the present disclosure, the length of the projection area in the longitudinal direction of the signal transmission line being one quarter wavelength means that, the length of the projection area in the longitudinal direction of the signal transmission line can be one quarter wavelength, or can be varied within a certain error range, e.g., 15%, if only the coupling between the coupling line and the signal transmission line can be realized. The wavelength refers to the wavelength of the signals (e.g., high frequency signals) transmitted in the signal transmission line or the coupling line.

In the embodiments of the present disclosure, the signal transmission line can be a primary signal line.

In the embodiments of the present disclosure, the circuit board can be a dual layer board or a multi-layer board. The two opposite surface layers of the circuit board can be copper sheet layers or conductive pattern layers, such as copper pattern layers, etc. The signal transmission line or the coupling line can be provided on the copper sheet layer or the conductive pattern layer.

In the embodiments of the present disclosure, the shielding house can be a hermetical or non-hermetical house, if only it can function as a shield. For example, it can be made of conductive material, such as metal materials (copper or aluminum, etc), or conductive materials containing metals, etc.

In the embodiments of the present disclosure, the circuit board can be entirely located within the shielding house, or it can extend outside of the shielding house. A trench may be provided on the shielding house and the circuit board can extend outside of the shielding house via the trench.

In the embodiments of the present disclosure, the material of the circuit board can be a material with better performance such as Rogers, Taconic, etc, or it can be a material with inferior performance such as FR4. Material costs can be saved if a material with inferior performance is used.

Figure 4:
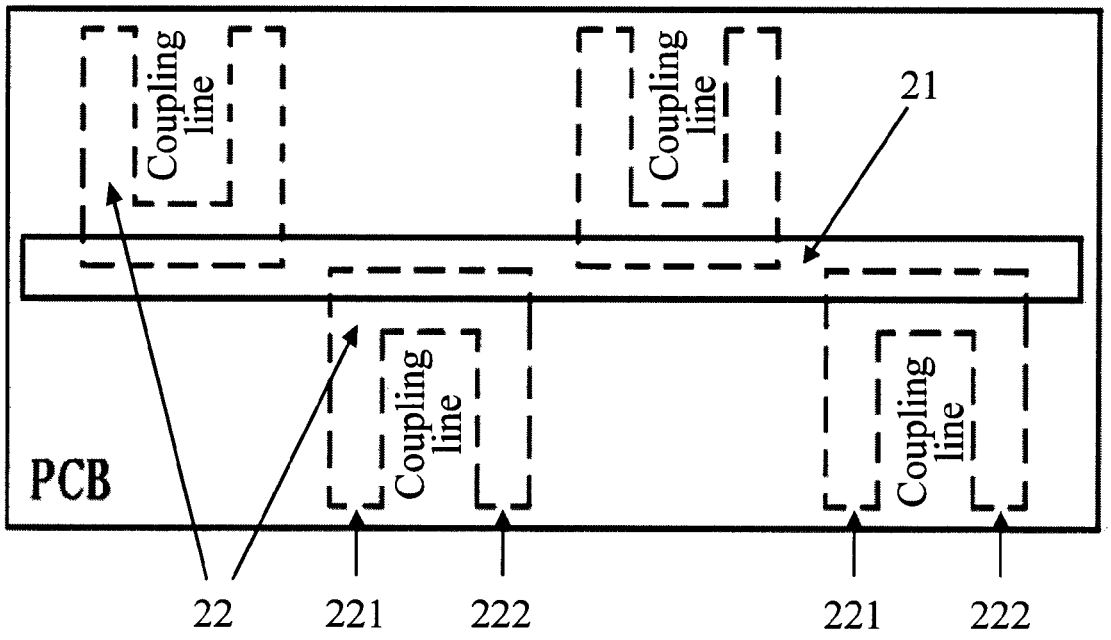
FIG. 4 is a schematic diagram depicting the manner in which the coupling line is set in the embodiments of the power division device of the present disclosure.

In the embodiments of the present disclosure, referring to FIG. 3 or FIG. 4, one or more coupling lines 22 may be provided. In the event of multiple coupling lines 22 being provided, the projection areas 211 formed by the coupling lines 22 can be located on one or both sides of the transmission line 21. If the projection areas 211 are respectively located on both sides of the signal transmission line 21, they can be alternately and evenly provided as one on the left side and one on the right side (the two sides of the signal transmission line can be respectively called left side and right side), or they can be alternately and unevenly provided as one on the left side and two on the right side, or three on the left side and four on the right side, etc.

Referring to FIG. 3 and FIG. 4, in the embodiments of the present disclosure, in the event of multiple coupling lines 22 being provided, the projection areas 211 formed by the coupling lines 22 can be evenly or non-evenly spaced. Distance between adjacent coupling lines 22 can be adjusted according to the coupling degree requirements. This will also change the space between the projection areas 211. The closer the adjacent projection areas 211 are to each other, the higher the coupling degree is; the further the adjacent projection areas 211 are to each other, the lower the coupling degree is.

In the embodiments of the present disclosure, the output signal interface is used for outputting signals. It can be connected to signal lines. The signal lines can extend outside of the shielding house from inside of the shielding house. In addition, the output signal interface may connect with an antenna array.

In the embodiments of the present disclosure, the coupling part of the coupling line, the output signal interface and the load interface can constitute a "U" shape, a "V" shape, or an "M" shape, etc.

In the embodiments of the present disclosure, the larger the depths of the projection areas formed by the multiple coupling lines are in the transverse direction of the signal transmission line, the higher the coupling degree is; the smaller the depths are, the lower the coupling degree is. The positions of the coupling lines can be respectively adjusted according to the coupling degree, to adjust the depths of the projection areas formed by the coupling line in the transverse direction of the signal transmission line. The depths of the projection areas in the transverse direction of the signal transmission line can be equal or unequal. The depth in the transverse direction refers to the length of a projection area in the transverse direction of the signal transmission line.

In the embodiments of the present disclosure, by adjusting the depths of the projection areas formed by multiple coupling line in the transverse direction of the signal transmission line, arbitrary n equal division sampling, or unequal division sampling of the signals transmitted in the signal transmission line can be achieved, where N is an integer greater than 0.

In the embodiments of the present disclosure, the load interface of the coupling line can be connected to an isolation resistor. The isolation resistor can be a load of 50 ohm, a load of 15 ohm, a load of 20 ohm, a load of 60 ohm, or a load of 80 ohm, etc. After the load interface is connected to an isolation resistor, the isolation between adjacent output signal interfaces can be enhanced. When the phase of the output signal interface changes, normal operations of other output signal interfaces will not be disturbed. Further, the signal transmission line and a single coupling line may constitute a stage of coupler. After the load interface is connected to the load resistor, the directivity of the single stage coupler can be enhanced.

Figure 5:
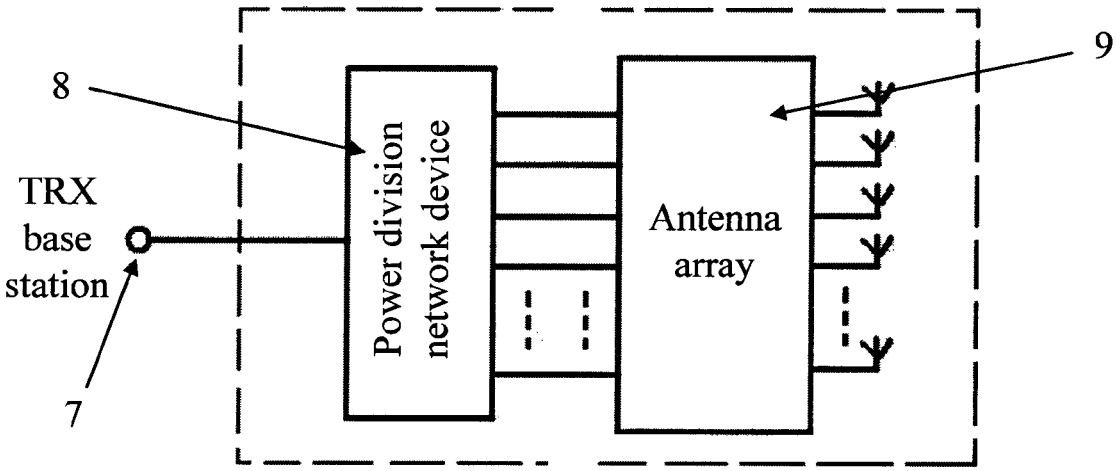
FIG. 5 is a schematic diagram depicting an embodiment of the communication device of the present disclosure.

As shown in FIG. 2, FIG. 3, and FIG. 5, an embodiment of an antenna feeder system of the present disclosure comprises a power division network device 8 and an antenna array 9. The power division network device 8 comprises a shielding house 1 and a circuit board 2. Two opposite surface layers of the circuit board 2 are respectively provided with a signal transmission line 21 and a coupling line 22. The signal transmission line 21 and the coupling line 22 of the circuit board 2 are suspended within the shielding house 1. The coupling line 22 comprises a coupling area 223, and a load interface 222 and an output signal interface 221 connected at the two ends of the coupling area 223. The projection of the coupling area 223 on the surface layer where the signal transmission line 21 is located falls onto the signal transmission line 21 and forms thereon a projection area 211. The length of the projection area 211 in the longitudinal direction of the signal transmission line is one quarter wavelength. The load interface 222 is connected to an isolation resistor. The output signal interface 221 is connected to an oscillator of the antenna array 9.

As shown in FIG. 2, FIG. 3, and FIG. 5, the present disclosure also provides an embodiment of a communication device. The communication device comprises a base station 7, a power division network device 8 and an antenna array 9. The power division network device 8 comprises a shielding house 1 and a circuit board 2. Two opposite surface layers of the circuit board 2 are respectively provided with a signal transmission line 21 and a coupling line 22. The signal transmission line 21 and the coupling line 22 are suspended within the shielding house 1. The coupling line 22 comprises a coupling area 223, and a load interface 222 and an output signal interface 221 connected at the two ends of the coupling area 223. The projection of the coupling area 223 on the surface layer where the signal transmission line 21 is located falls onto the signal transmission line 21 and forms thereon a projection area 211. The length of the projection area 211 in the longitudinal direction of the signal transmission line is one quarter wavelength. The base station 7 is connected to the signal transmission line 21 of the power division network device 8. The load interface 222 of the power division network device 8 is connected to an isolation resistor. The output signal interface 221 of the power division network device 8 is connected to the antenna array 9.

As shown in FIG. 2 and FIG. 3, an embodiment of a communication device of the present disclosure comprises a power division network device. The power division network device comprises a shielding house 1 and a circuit board 2. Two opposite surface layers of the circuit board 2 are respectively provided with a signal transmission line 21 and a coupling line 22. The signal transmission line 21 and the coupling line 22 of the circuit board 2 are suspended within the shielding house 1. The coupling line 22 comprises a coupling area 223, and a load interface 222 and an output signal interface 221 connected at the two ends of the coupling area 223. The projection of the coupling area 223 on the surface layer where the signal transmission line 21 is located falls onto the signal transmission line 21 and forms thereon a projection area 211. The length of the projection area 211 in the longitudinal direction of the signal transmission line is one quarter wavelength. The load interface 222 is connected to an isolation resistor.

The communication device may be a server, a gateway, a terminal, a signal transmitting station, or a radio transmitting station, etc.

The above are merely some embodiments of the present disclosure. Those of ordinary skill in the art may modify or change the present disclosure based upon the disclosed contents without departing from the spirit and scope of the present disclosure.

What is claimed is:

1. A power division network device, comprising:

a shielding house; and a circuit board, wherein two opposite surface layers of the circuit board are respectively provided with a signal transmission line and a coupling line, wherein the signal transmission line and the coupling line are suspended within the shielding house, wherein the coupling line comprises a coupling area, wherein a load interface and an output signal interface are connected at two ends of the coupling area, wherein a projection of the coupling area on the surface layer where the signal transmission line is located falls onto the signal transmission line and forms thereon a projection area, wherein a length of the projection area in a longitudinal direction of the signal transmission line is one quarter wavelength, wherein the coupling line comprises multiple coupling lines, wherein the multiple coupling lines form multiple projection areas, and wherein the multiple projection areas are respectively located on one side or on both sides of the signal transmission line.

2. The power division network device according to claim 1, wherein the circuit board is entirely located in the shielding house, or wherein the circuit board extends outside of the shielding house.

3. The power division network device according to claim 1, wherein the multiple projection areas formed by the multiple coupling lines are respectively located on the both sides of the signal transmission line, wherein the multiple projection areas are alternately and evenly provided or alternately and unevenly provided on the both sides of the signal transmission line, wherein the multiple projection areas are evenly or unevenly spaced, or wherein depths of the multiple projection areas in a transverse direction of the transmission signal line are equal or unequal.

4. An antenna feeder system, comprising:

a power division network device; and an antenna array, wherein the power division network device comprises a shielding house and a circuit board, wherein two opposite surface layers of the circuit board are respectively provided with a signal transmission line and a coupling line, wherein the signal transmission line and the coupling line are suspended within the shielding house, wherein the coupling line comprises a coupling area, wherein a load interface and an output signal interface are connected at two ends of the coupling area, wherein a projection of the coupling area on the surface layer where the signal transmission line is located falls onto the signal transmission line and forms thereon a projection area, and wherein a length of the projection area in a longitudinal direction of the signal transmission line is one quarter wavelength.

5. The antenna feeder system according to claim 4, wherein the coupling line comprises multiple coupling lines, wherein multiple projection areas are formed by the multiple coupling lines, and wherein the multiple projection areas are respectively located on one side or both sides of the signal transmission line.

6. The antenna feeder system according to claim 4, wherein the coupling line comprises multiple coupling lines, wherein multiple projection areas are formed by the multiple coupling lines, wherein the multiple projection areas are respectively located on both sides of the signal transmission line, wherein the projection areas are alternately and evenly provided or are alternately and unevenly provided on the both sides of the signal transmission line, wherein the projection areas are evenly or unevenly spaced, or wherein depths of the projection areas in a transverse direction of the transmission signal line are equal or unequal.

7. A communication device, comprising:

a base station;

a power division network device; and an antenna array, wherein the power division network device comprises a shielding house and a circuit board, wherein two opposite surface layers of the circuit board are respectively provided with a signal transmission line and a coupling line, wherein the signal transmission line and the coupling line are suspended within the shielding house, wherein the coupling line comprises a coupling area, wherein a load interface and an output signal interface are connected at two ends of the coupling area, wherein a projection of the coupling area on the surface layer where the signal transmission line is located falls onto the signal transmission line and forms thereon a projection area, wherein a length of the projection area in a longitudinal direction of the signal transmission line is one quarter wavelength, wherein the base station is connected to the signal transmission line of the power division network device, and wherein the output signal interface of the power division network device is connected to the antenna array.

8. The communication device according to claim 7, wherein the coupling line comprises multiple coupling lines, wherein multiple projection areas are formed by the multiple coupling lines, and wherein the multiple coupling lines are respectively located on one side or both sides of the signal transmission line.

9. The communication device according to claim 7, wherein the coupling line comprises multiple coupling lines, wherein multiple projection areas are formed by the multiple coupling lines, wherein the multiple coupling lines are respectively located on both sides of the signal transmission line, wherein the multiple projection areas are alternately and evenly provided or are alternately and unevenly provided on the both sides of the signal transmission line, wherein the multiple projection areas are evenly or unevenly spaced, or wherein depths of the multiple projection areas in a transverse direction of the transmission signal line are equal or unequal.

* * * * *